US010093437B2

(12) United States Patent
Loda

(10) Patent No.: US 10,093,437 B2
(45) Date of Patent: Oct. 9, 2018

(54) HIGH PERFORMANCE INSULATION PACKAGING AND DISBURSEMENT SYSTEM

(71) Applicant: David Charles Loda, Hartford, CT (US)

(72) Inventor: David Charles Loda, Hartford, CT (US)

(73) Assignee: David Charles Loda, Bolton, CT (US)

( * ) Notice: Subject to any disclaimer, the term of this patent is extended or adjusted under 35 U.S.C. 154(b) by 0 days.

(21) Appl. No.: 15/160,793

(22) Filed: May 20, 2016

(65) Prior Publication Data

US 2016/0340064 A1 Nov. 24, 2016

Related U.S. Application Data

(60) Provisional application No. 62/163,983, filed on May 20, 2015.

(51) Int. Cl.

| | |
|---|---|
| ***B65B 1/16*** | (2006.01) |
| ***E04B 1/76*** | (2006.01) |
| ***E04B 1/78*** | (2006.01) |
| ***E04B 1/88*** | (2006.01) |

(Continued)

(52) U.S. Cl.

CPC ..... *B65B 1/16* (2013.01); *B65B 51/10* (2013.01); *B65B 61/10* (2013.01); *E04B 1/7604* (2013.01); *E04B 1/78* (2013.01); *E04B 1/88* (2013.01)

(58) Field of Classification Search

CPC ..... B65D 75/50

See application file for complete search history.

(56) References Cited

U.S. PATENT DOCUMENTS 3,667,593 A * 6/1972 Pendleton ..... B29C 65/18 206/522

3,863,758 A * 2/1975 Connelly ..... B29C 70/12 206/484

(Continued)

FOREIGN PATENT DOCUMENTS

WO WO 2016004957 A1 * 1/2016 ..... E04B 1/76

OTHER PUBLICATIONS

Fat Brain Toys "How to Make Balloon Animals Kit" Published Nov. 2007 <https://web.archive.org/web/20071109174721/https://www.fatbraintoys.com/toy_compan ies/schylli ng/how_to_make_balloon_animalskit.cfm>.*

(Continued)

*Primary Examiner* — Jacob Cigna

(74) *Attorney, Agent, or Firm* — Oblon, McClelland, Maier & Neustadt, L.L.P.

(57) ABSTRACT

A method for packaging and installing high performance insulation of a loose, granular, moisture-resistant nature, suitable for providing insulation in walls, ceilings, or other cavities in traditional buildings, cabinets or other structures requiring thermal or sound insulation, in a practical, easy to manage, modular fashion. The method provides for the packaging of insulation material to be contained in an air-tight but moisture permeable material that traps the particulates but not moisture vapor. The insulation material may also be blended with other materials to adjust the product's resistance to thermal or sound conductivity, cost, and in order to prevent leakage in the event of puncture.

11 Claims, 6 Drawing Sheets

(51) Int. Cl.
*B65B 61/10* (2006.01)
*B65B 51/10* (2006.01)

(56) References Cited

U.S. PATENT DOCUMENTS

| | | | | |
|---|---|---|---|---|
| 3,879,917 | A * | 4/1975 | Bassendale | B65B 9/213 222/108 |
| 4,556,593 | A * | 12/1985 | Hughes | F16L 59/028 428/102 |
| 4,825,089 | A * | 4/1989 | Lindsay | E04B 1/7654 250/515.1 |
| 5,545,279 | A * | 8/1996 | Hall | B29C 63/044 156/201 |
| 5,656,346 | A | 8/1997 | Hirt | |
| 6,105,335 | A * | 8/2000 | Vohra | E04B 1/7604 52/293.1 |
| 6,209,286 | B1 * | 4/2001 | Perkins | B31D 5/0073 156/145 |
| 6,319,444 | B1 * | 11/2001 | Kirk | B29C 70/34 264/136 |
| 6,598,283 | B2 | 7/2003 | Rouanet et al. | |
| 8,728,605 | B2 * | 5/2014 | Payne | B32B 3/266 428/308.4 |
| 9,097,377 | B2 * | 8/2015 | Kim | F16L 59/029 |
| 9,305,536 | B2 * | 4/2016 | Cuylits | D04B 1/14 |
| 2003/0145545 | A1 * | 8/2003 | Alderman | B29C 65/18 52/404.1 |
| 2006/0185288 | A1 * | 8/2006 | Vineberg | A01G 9/225 52/408 |
| 2006/0194026 | A1 | 8/2006 | Blair et al. | |
| 2006/0240216 | A1 * | 10/2006 | Stepanian | F16L 59/065 428/76 |
| 2007/0004306 | A1 | 1/2007 | Leeser et al. | |
| 2007/0036961 | A1 * | 2/2007 | LaSalle | E04B 1/7604 428/292.1 |
| 2007/0154698 | A1 * | 7/2007 | Stepanian | B32B 5/02 428/294.7 |
| 2008/0014402 | A1 | 1/2008 | Tomich | |
| 2008/0178559 | A1 * | 7/2008 | DeFedericis | B65B 61/20 53/469 |
| 2011/0197987 | A1 * | 8/2011 | Koravos | F16L 59/026 138/149 |
| 2012/0141719 | A1 * | 6/2012 | Payne | B32B 3/266 428/68 |
| 2014/0004290 | A1 * | 1/2014 | Kim | F16L 59/029 428/71 |
| 2014/0161677 | A1 * | 6/2014 | Latham | F01N 13/18 422/168 |
| 2014/0196305 | A1 * | 7/2014 | Smith | F28D 20/023 34/468 |
| 2016/0084424 | A1 * | 3/2016 | Kuhn | F16L 59/065 53/427 |

OTHER PUBLICATIONS

Dickman, K., "Forget Down—Aerogel is the Insulator of the Future", URL: http://www.outsideonline.com/1919251/forget-down%E2%80%94aerogel-insulator-future, Outside, 2 Pages total, (Mar. 29, 2013).

Alotaibi, S.S., et al., "Vacuum Insulated Panels for Sustainable Buildings: a Review of Research and Applications", URL: http://onlinelibrary.wiley.com/doi/10.1002/er.3101/full, International Journal of Energy Research, vol. 38, No. 1, 35 Pages total, (Oct. 9, 2013).

* cited by examiner

HIGH PERFORMANCE INSULATION PACKAGING AND DISBURSEMENT SYSTEM

RELATED APPLICATIONS

This application claims the priority of the filing date of U.S. Provisional Patent Application No. 62/163,983 filed May 20, 2015, the disclosure of which is hereby incorporated herein by reference.

BACKGROUND OF THE INVENTION

Field of the Invention

This disclosure relates to a method of packaging and installing particulate insulation material.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

The primary purpose of insulation in any application is to trap air, as a dead air space is one of the most effective blockages to convective heat transfer in buildings and structures. It is also highly effective in blocking sound. The problem with air, however, is that small convective cycles within the space can transmit heat from the warmer side of the space to the colder side whenever there is a difference in temperature. To reduce this loss, manufacturers have developed different methods to trap air in their products over the years, all with a similar goal in mind: to create the greatest number of closed air pockets as is economically feasible. The idea is that the smaller the air pockets trapped in the insulating material, the less likely an effective internal convective heat transfer cycle can form, and thus the greater the insulating value.

Moist vapor is the other significant issue, as the warm, moist interior of a home during the winter stands in sharp contrast to the colder, usually dryer air outside. Moist, heat laden air will naturally permeate through walls and ceilings to the colder, dryer air outside. The reverse is true of a home air conditioned in the summer. Current products attempt to reduce the heat and moisture transfer from the inside to outside, or vice versa, but must retain a measure of moisture vapor transfer capability (breathability) to prevent trapping the moisture and causing decomposition of the wall components. If not properly designed, insulating products could cause significant health and structural issues down the road, encouraging the growth of mold, insects, etc., as well as causing peeling paint on the outside and eventually rotting of the underlying structure.

The use of different types of insulation for construction is well known, particularly in the home and commercial building industries. For most practical building applications, they can be generally categorized into three major categories: fiber wool, which usually comes in rolls or batts that are placed in wall or ceiling cavities; cellulose, which is loosely blown into enclosed cavities or on top of attic floors; and closed cell foam, including extruded polystyrene and polyisocyanurate, which come in stiff boards of varying thickness and sizes, or are sometimes applied in an expanding foam spray.

Silica fiberglass is by far the most popular application for building insulation, as it is relatively inexpensive, lightweight and will conform to most any shape. A layer of moisture resistant paper or foil is usually applied on the side closed to the livening space to protect against moisture and reflect radiant heat, though the fiberglass itself allows moisture to move freely. The down side is that they are made of the crystalline form of silica dioxide (sand or glass), so breathing the particles when installing can be hazardous. They also lose their thermal efficiency when the moisture level (relative humidity) is high.

Cellulose fibers are made of paper or plant by-products, such as recycled newspapers or plant fibers from cotton mills. Although relatively harmless in their basic form, they are usually treated with toxic chemicals to give them fire retardant and moisture resistant properties before being delivered to the building site and blown in. These along with old newspaper ink and other residual chemicals, could outgas toxic chemical compounds. Insulation values are only marginally better than fiberglass, but both types, once wet, will retain significant amounts of moisture for extended periods of time. Lastly, closed cell foams provide the greatest thermal efficiencies, given the smaller size and permanence of internally trapped air cells. But they are difficult to work with and produce toxic chemicals and gasses in both their production and later outgassing.

In view of the foregoing, the objective of the present disclosure is to provide a safe, economical method of packaging and installation of new types of highly efficient particulate insulation material, such as an aerogel, to replace traditional insulation applications with significantly improved energy efficiency, and a more environmentally friendly approach.

SUMMARY OF THE DISCLOSURE

The foregoing description is intended to provide a general introduction and summary of the present disclosure and is not intended to be limiting in its disclosure unless otherwise explicitly stated. The various embodiments, together with further advantages, will be best understood by reference to the following detailed description taken in conjunction with the accompanying drawings.

A first aspect of this disclosure relates to a method for forming a packet of insulation material, the method comprising: (i) injecting an insulation material into an interior volume of a tube having a closed first end and an opened second end with an injection apparatus inserted into the second end of the tube, and (ii) segmenting the tube thereby forming the packet of insulation material.

In one embodiment, the insulation material comprises at least one material selected from the group consisting of silica aerogel in the form of a powder, fiberglass, and mineral wool.

In one embodiment, the insulation material further comprises at least one material selected from the group consisting of polyester, cellulose, polystyrene, and polyurethane.

In one embodiment, the tube is round and comprises a thermoplastic.

In one embodiment, the tube comprises spun polyethylene.

In one embodiment, the injection apparatus injects the insulation material into the interior volume of the tube with pressurized air.

In one embodiment, the pressurized air has a pressure ranging from 80-160 psi.

In one embodiment, the tube is segmented with at least one heated blade.

In one embodiment, the tube is segmented with a cutter assembly comprising at least one cutting unit which comprises: (i) a blade to divide the tube into a plurality of segments, and (ii) a heated plate to seal the cut edges of each segment thereby forming the packet of insulation material.

In one embodiment, the blade bisects the heated plate and is perpendicular to the heated plate.

In one embodiment, there are at least three cutting units and the cutting units are spaced apart equally.

A second aspect of this disclosure relates to another method for forming a packet of insulation material, the method comprising: (i) laying an insulation material on a surface of a first sheet comprising a thermoplastic, (ii) placing a second sheet comprising the thermoplastic on top of the insulation material thereby forming a sandwich, (iii) placing the sandwich between a top plate and a bottom plate of a die set, wherein a surface of the top plate has a plurality of ridges parallel and perpendicular to a longitudinal axis of the top plate, a surface of the bottom plate has a plurality of grooves parallel and perpendicular to a longitudinal axis of the bottom plate, and each ridge is sized to fit into each groove, and (iv) segmenting the sandwich by applying a pressure to the top plate of the die set thereby forming the packet of insulation material.

In one embodiment, the insulation material comprises at least one material selected from the group consisting of silica aerogel in the form of a powder, fiberglass, and mineral wool.

In one embodiment, the insulation material further comprises at least one material selected from the group consisting of polyester, cellulose, polystyrene, and polyurethane.

In one embodiment, the tube is made of a moisture permeable material.

In one embodiment, the thermoplastic is spun polyethylene.

A third aspect of this disclosure relates to a packet of insulation material, comprising an insulation material encased in a sealed casing, wherein the packet of insulation material has a length ranging from 1-30 cm, a width ranging from 2-15 cm, and a thickness ranging from 2-15 cm.

In one embodiment, the insulation material comprises at least one material selected from the group consisting of silica aerogel in the form of a powder, fiberglass, and mineral wool.

In one embodiment, the insulation material further comprises at least one material selected from the group consisting of polyester, cellulose, polystyrene, and polyurethane.

In one embodiment, the sealed casing comprises a thermoplastic.

In one embodiment, the sealed casing comprises spun polyethylene.

A fourth aspect of this disclosure relates to a method for insulating buildings, comprising filling a cavity of at least one of a wall and a ceiling with the packet of the third aspect.

A fifth aspect of this disclosure relates to the methodology of isolating the granular insulation into small packets so that should any intrusions into the insulated space occur, such as a screw, to hold a picture onto a wall, leakage is limited to only the packet(s) punctured.

DETAILED DESCRIPTION OF THE DISCLOSURE

Embodiments of the present disclosure will now be described more fully hereinafter with reference to the accompanying drawings, in which some, but not all embodiments of the disclosure are shown.

Figure 1:
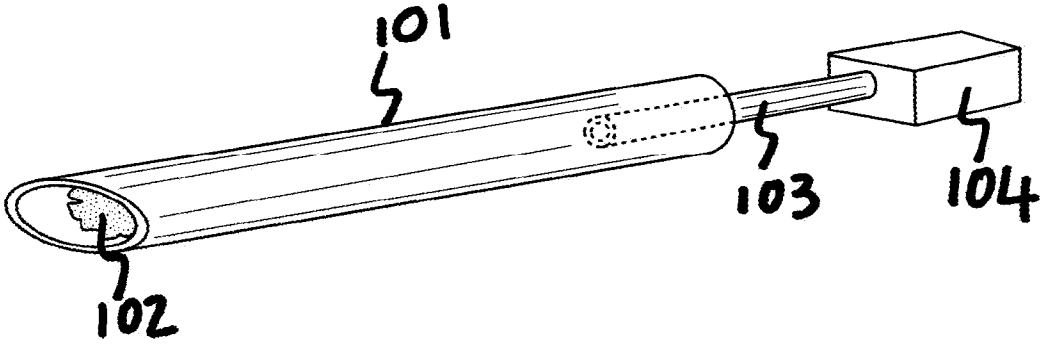
FIG. 1 shows an embodiment of filling the tube with the insulation material.
Figure 2:
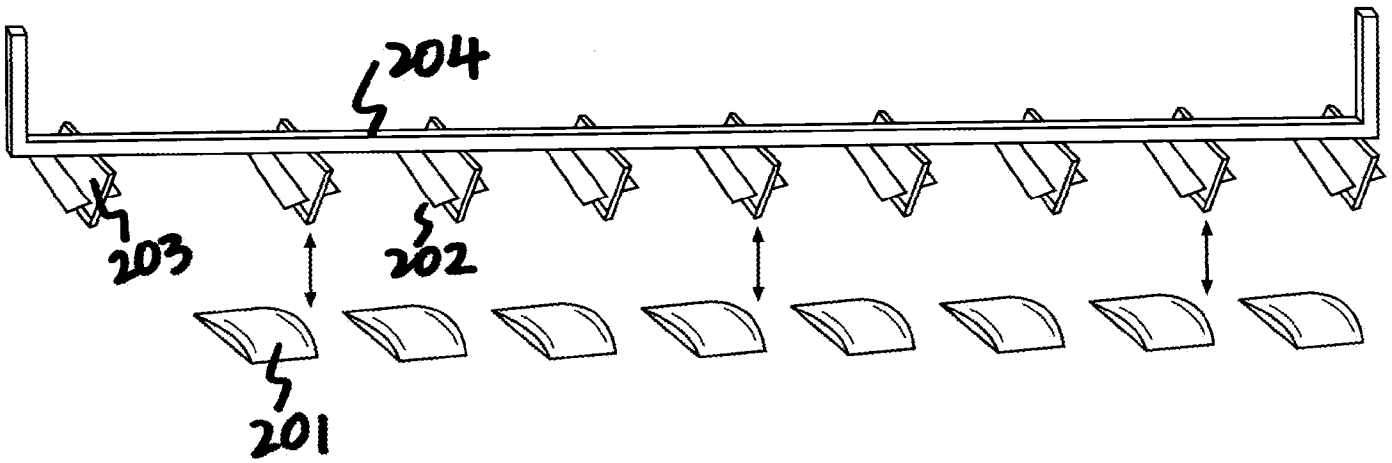
FIG. 2 shows an embodiment of segmenting the packed tube into packets of insulation material.
Figure 3:
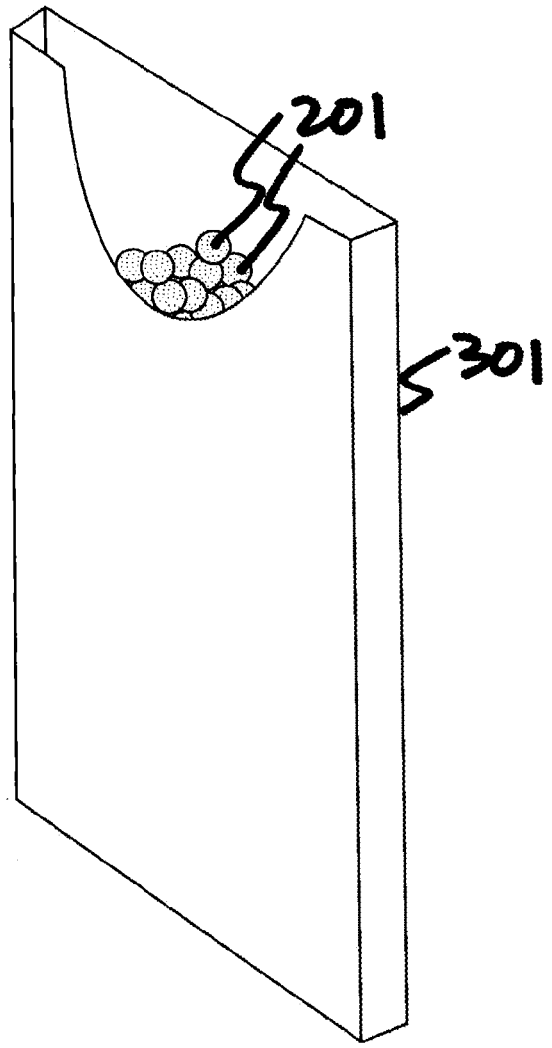
FIG. 3 shows a wall cavity filled with packets of insulation material.
Figure 4:
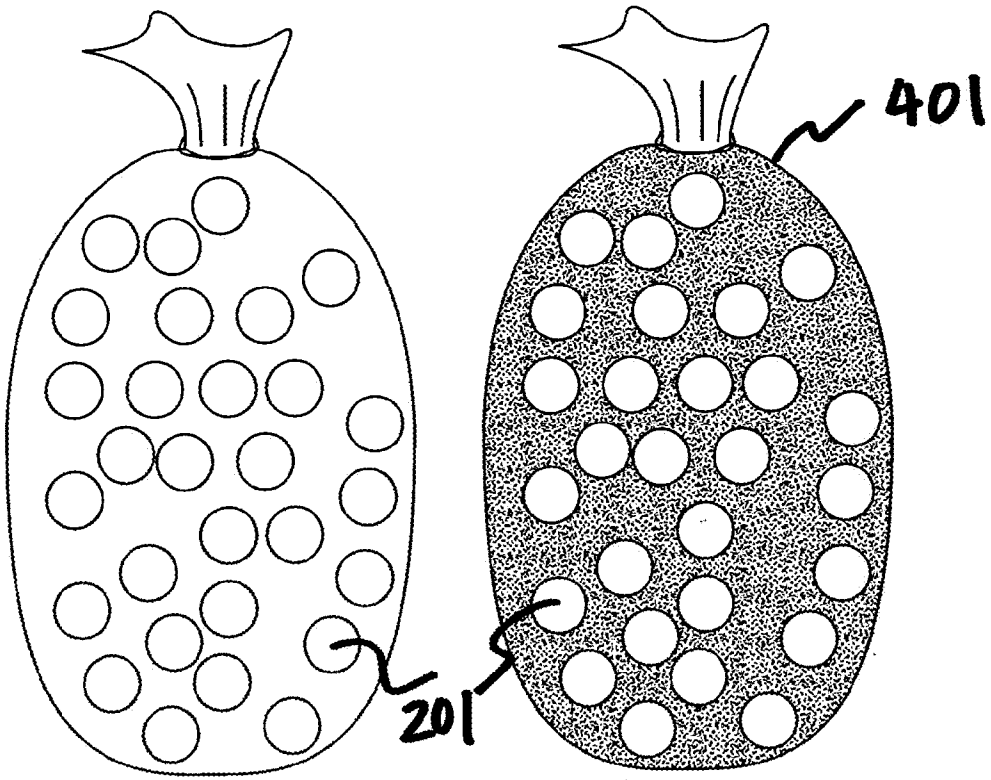
FIG. 4 shows the packing of the packets in a bag for sales and distribution.
Figure 5:
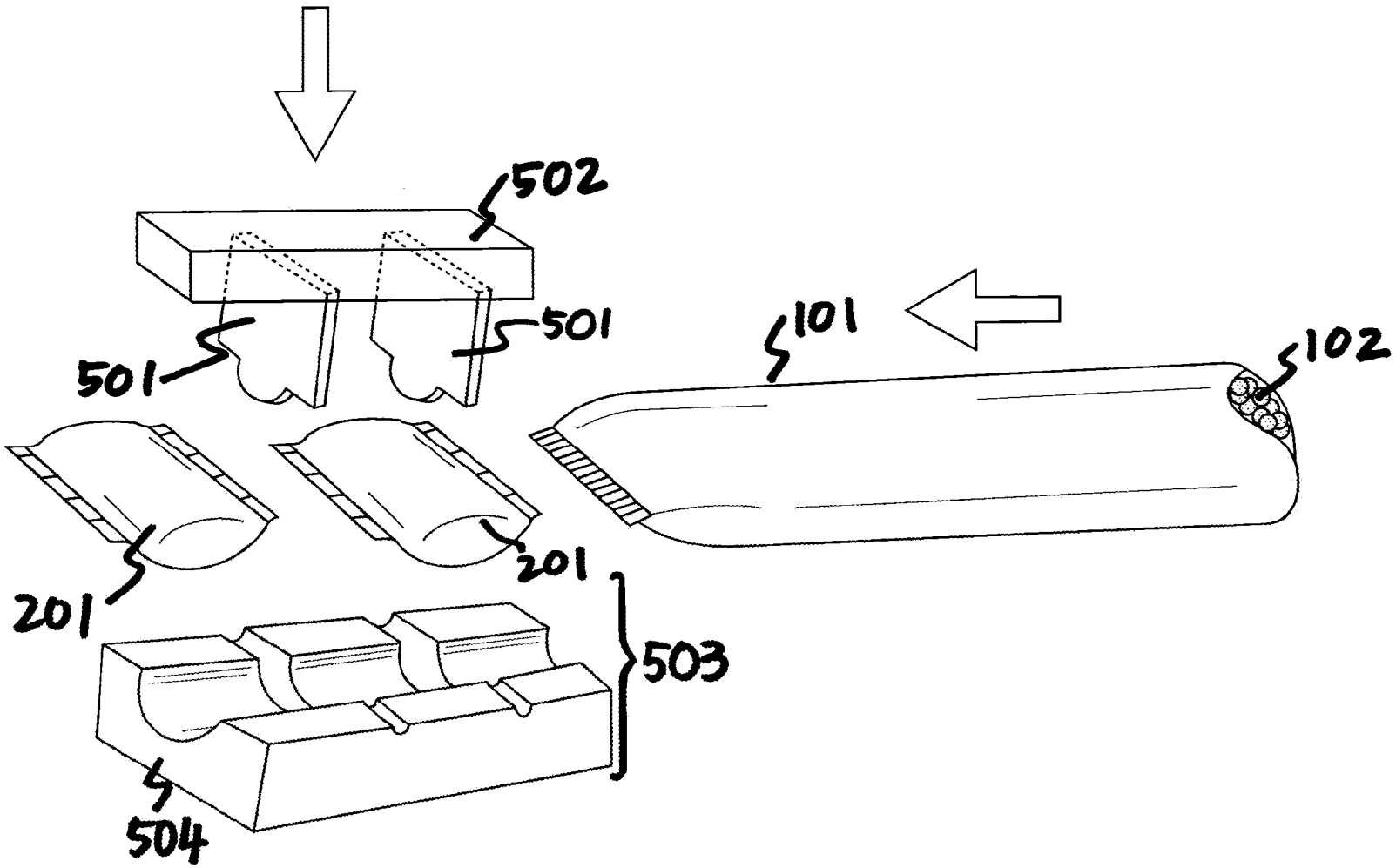
FIG. 5 shows another embodiment of segmenting the packed tube into packets of insulation material.

Referring to FIGS. 1, 2, and 5, the first aspect of the disclosure relates to a method for forming a packet of insulation material. The packet of insulation material may be employed for providing sound and/or thermal insulation. The insulation material 102 may comprise silica aerogel in the form of a powder, mineral wool, and/or fiberglass. In one embodiment, the insulation material comprises silica aerogel powder. Silica aerogel is a synthetic porous ultralight material derived from a silica gel by supercritical drying—the liquid is extracted from the silica gel framework while preserving at least 50%, for example at least 80%, and at least 90% of the original volume of the silica gel framework. Silica aerogel has remarkable thermal insulation properties such as an extremely low thermal conductivity. The building material R-value for the silica aerogel ranges from 6-20 per inch of material, such as 6-15 per inch of material, and 6-10 per inch of material. For comparison purposes, fiberglass has a R-value in a range of 1-10 per inch of material, such as 1-6 per inch of material, and 2-4 per inch of material. Fiberglass is crystalline and causes itchiness and potential health problems if inhaled as it floats in air. Silica aerogel is amorphous, and thus this characteristic makes silica aerogel more of an environmentally friendly material and safer to work with.

Silica aerogel powder has a low bulk density ranging from 50-120 kg/m$^3$, such as 65-100 kg/m$^3$, and 75-95 kg/m$^3$. A diameter of the silica aerogel powder particles ranges from 0.01-10 mm, such as 0.01-8 mm, 0.01-4 mm, and 0.01-1.2 mm. As used herein, the term "diameter" refers to a longest distance measured between two points on a particle. In another embodiment, the diameter of the silica aerogel powder particles ranges from 1.2-4 mm. In some embodiments, the diameter of the silica aerogel powder particles ranges from 10-100 μm, such as 40-80 μm, and 50-70 μm. The porosity of the silica aerogel powder particles can be at least 70%, such as at least 80%, and at least 90%. Silica aerogel powder particles comprise pores with diameters ranging from 5-50 nm, such as 10-40 nm, and 15-25 nm. These pores trap air, making silica aerogel powder an efficient insulator. Silica aerogel powder particles may have a hydrophilic or a hydrophobic surface. Preferably, they have a hydrophobic surface that repels water and keeps the cavities in walls and ceilings dry. They have a surface area ranging from 400-1000 m$^3$/g, such as 500-800 m$^3$/g, and 600-800 m$^3$/g. Silica aerogel powder particles may be spheres, ellipsoids, and/or polygons. Non-limiting examples of polygons are triangles, squares, rectangles, and hexagons. In a preferred embodiment, the aerogel particles are irregularly shaped.

In some embodiments, the insulation consists of the silica aerogel and in other embodiments, the insulation material may comprise both silica aerogel particles and another insulation material such as fiberglass, glass wool, mineral wool, paper (recycled or virgin), cotton (such as denim), or combinations of these. The volume ratio of the silica aerogel to the other insulation materials can range from 10:90 to 99:1, such as from 20:80 to 90:10, and from 70:30 to 90:10. In some embodiments, the insulation material may comprise both mineral and glass wool in a volume ratio which ranges from 10:90 to 99:1, such as from 20:80 to 90:10, and from 70:30 to 90:10.

In some embodiments, one or more filler materials may be blended with the insulation material to achieve various R-values to suit different construction designs. Therefore, the insulation material may further comprise a filler, which may be a polymer such as polyester, cellulose, polystyrene, polyurethane, and mixtures thereof. The volume ratio of the silica aerogel powder particles, and other insulation materials, if present, to the polymer may range from 30:70 to 99:1, such as from 50:50 to 90:10, and from 70:30 to 90:10. The polymer may be in the form of a fiber or a bead. Preferably, the polymer is in the form of a bead with a diameter ranging from 0.1-5 mm, such as 0.5-4 mm, and 0.8-1.2 mm. In another embodiment, polyester fibers, which are used to fill pillows, are mixed with silica aerogel powder particles, mineral wool, and/or fiberglass.

When the insulation material includes a combination of materials (e.g., silica aerogel and mineral wool), the materials can be premixed prior to filling, added separately to the packet and mixed therein, or added simultaneously in a manner that will facilitate mixing of the combination of materials. In some embodiments, the combination mixture may be substantially homogenous and in other embodiments a simple mixture of the combination of materials can be provided.

In some embodiments, the packet of insulation material is formed with an automated assembly-line product packaging system, such as a vertical form fill seal machine or a sachet form fill seal machine, known to those in the food and/or packaging industries.

In some embodiments, an injection apparatus comprising a supply chamber 104 and a nozzle 103 is employed to fill the tube 101 with insulation material 102. As used herein, the term "tube", refers to a preformed tube with an interior volume as well as a collapsed tube which expands when filled with insulation material. The supply chamber is filled with the insulation material by an operator or a conveyor system well known to those in the food and/or packaging industries. In some embodiments, the insulation material comprises at least two components (e.g. silica aerogel powder and mineral wool), which are pre-mixed in an industrial mixer before transferring to the supply chamber. The injection apparatus is fluidly connected to a pump, such as a turbine compressor, a scroll compressor, a piston compressor, or a screw type compressor, which produces a compressed air stream to force the insulation material out of the supply chamber and into the nozzle in order to fill the tube. In one embodiment, a scroll compressor is employed. The pressurized air has a pressure ranging from 80-160 psi, such as 90-120 psi, and 95-105 psi, and may be controlled by air valves.

A volume of the supply chamber may range from 0.5-50 L, such as 1-30 L, and 1-10 L. An outer diameter of the nozzle is at least 10% shorter than the diameter of the tube, such as 20% shorter, and 30% shorter, to fit within the tube. The outer diameter of the nozzle may range from 1.4-18 cm, such as 1.4-9 cm, and 1.4-6.3 cm.

The tube may be a round tube, a rectangular tube, a square tube, a streamline tube, a flat tube, a half-round tube, a half-oval tube. In one embodiment, the tube is round and is in the form of a cylinder. The outer diameter of the tube can vary based on the desired size, for instance based on the space in which the tube will be installed. For example, the outer diameter of the tube can range from 2-20 cm, such as 2-10 cm, and 2-7 cm. The wall thickness of the tube can range from 0.1-10 mm, such as 0.5-7 mm, and 1-3 mm. The length of the tube also can vary based on the desired size, for instance based on the space in which the tube will be installed. For example, the length of the tube can range from 1-50 m, such as 5-40 m, and 10-30 m.

The tube may be made of craft paper, burlap, or a thermoplastic such as polystyrene, polyester, nylon, and polypropylene. The tube may be opaque, translucent, or transparent. Preferably, the tube is opaque. In certain embodiments, the tube is made of a material, for example, polymeric, that has a high moisture vapor transmission rate to permit the transfer of moisture through the space of the tube. In some embodiments, the tube has UV resistance. In one aspect, the tube comprises spun polyethylene, for example, Tyvek®, which contains the insulation material while allowing water vapor to pass freely, a feature that can be important in some building insulation application.

The insulation material may take up at least 80% of the interior volume of the tube, such as at least 90%, and at least 95%. Subsequent to filling the tube, the nozzle may be partially retracted into the supply chamber so that the nozzle does not interfere with the segmenting process. In one embodiment, the injection apparatus is withdrawn, so that the second end of the tube may be sealed by thermal bonding, glue, adhesives, and/or any other technique which is known to those of ordinary skill in the art, to prevent the insulation material from falling out of the tube when handled.

The tube may be placed on a grooved metal plate 503 with the first end flushed with a face 504 of the grooved metal plate, which provides a firm surface for cutting the tube and shapes the packets of insulation material 201. The tube is then segmented into packets of insulation material with at least one heated blade 501 which are welded to a metal bar 502. The tube and the grooved metal plate may be oriented such that both the longitudinal axes of the tube and grooved metal plate are parallel or perpendicular to the ground. In one embodiment, both the longitudinal axes of the tube and grooved metal plate are parallel to the ground. The heated blade may have a flat grind, a taper grind, a hollow grind or a convex grind. In one embodiment, the heated blade has a flat grind. The length of the heated blade can be at least 5% longer than the diameter of the tube, such as 10% longer, and 20% longer to ensure a clean cut. The length of heated blade can range from 2.1-24 cm, such as 2.1-12 cm, and 2.1-8.4 cm. The thickness of the heated blade can range from 0.1-2 mm, such as 0.1-1 mm, and 0.3-0.6 mm. The interior of the heated blade comprises a heating element that heats the blade by resistive heating. A temperature of the heated blade can range from 80-400° C., such as 80-200° C., and 80-150° C. The heated blade severs the terminal end of the tube, seals the exposed edge by welding the plastic at the edge thereby forming a packet of insulation material. The tube may then be advanced manually or by a conveyor system known to those skilled in the art.

The packet of insulation material may have a length ranging from 1-30 cm, preferably 2-15 cm, more preferably 2-7 cm, a width ranging from 2-15 cm, preferably 2-10 cm, more preferably 2-7 cm, and a thickness ranging from 2-15 cm, preferably 2-10 cm, more preferably 2-7 cm. A shape of the packet may be rectangular or squarish. The packet of insulation material may be sized to stack vertically, on top of one another, or combinations thereof, in the wall/ceiling cavity. In one embodiment, the packet of insulation is sized like a batt to fill the whole wall/ceiling cavity.

In another embodiment, the tube is segmented with a cutter assembly comprising at least one cutting unit which comprises (i) a blade to divide the tube into a plurality of segments, and (ii) a heated plate to seal the cut edges of each segment thereby forming the packet of insulation material.

The at least one cutting unit may be welded to a metal bar 204 with handles at both ends for easy operation. For example, the top of the blade (i.e. the spine) is welded to the metal bar 204. The metal bar 204 can have a length ranging from 1-2.5 m, such as 1.3-2 m, and 1.5-1.8 m, and a thickness of 1-5 cm, such as 1-3 cm, and 1.5-2.5 cm. The metal bar 204 may be made of stainless steel, tool steel, alloy steel, or cobalt and titanium alloys. In an advantageous embodiment, the metal bar 204 is made of stainless steel. The heated plate 202 may be made from carbon steel, stainless steel, tool steel, alloy steel, cobalt and titanium alloys, or ceramic. The interior of the heated plate 202 can comprise a heating element that heats the plate by resistive heating. A temperature of the heated plate 202 can range from 80-400° C., such as 80-200 ° C., and 80-150° C. The plate 202 may be oriented with its longitudinal axis perpendicular to that of the tube. The plate 202 may be a rectangle or a square. In one embodiment, the plate 202 is a rectangle with a length ranging from 3-30 cm, such as 3-15 cm, and 3-10 cm.

The blade 203 is perpendicular to the heated plate and bisects the plate 202. The blade 203 is welded to the plate. The blade 203 may have a flat grind, a taper grind, a hollow grind or a convex grind. Preferably, the blade 203 has a flat grind. The length of the blade 203 is at least 5% longer than the diameter of the tube, such as 10% longer, and 20% longer to ensure a clean cut. The length of blade 203 can range from 2.1-24 cm, such as 2.1-12 cm, and 2.1-8.4 cm. The thickness of the blade 203 can range from 0.1-2 mm, such as 0.1-1 mm, and 0.3-0.6 mm.

In one embodiment, there are at least three cutting units arranged in a row, with the blades parallel to one another and the cutting units are spaced apart equally. The distance, measured from a first blade to a second blade, translates to the length of the packet of insulation material. The distance between the blades can be changed depending on the size of the desired resulting packet. In some embodiments, the distance between the blades can range from 1-30 cm, such as 2-15 cm, and 2-7 cm.

Figure 6:
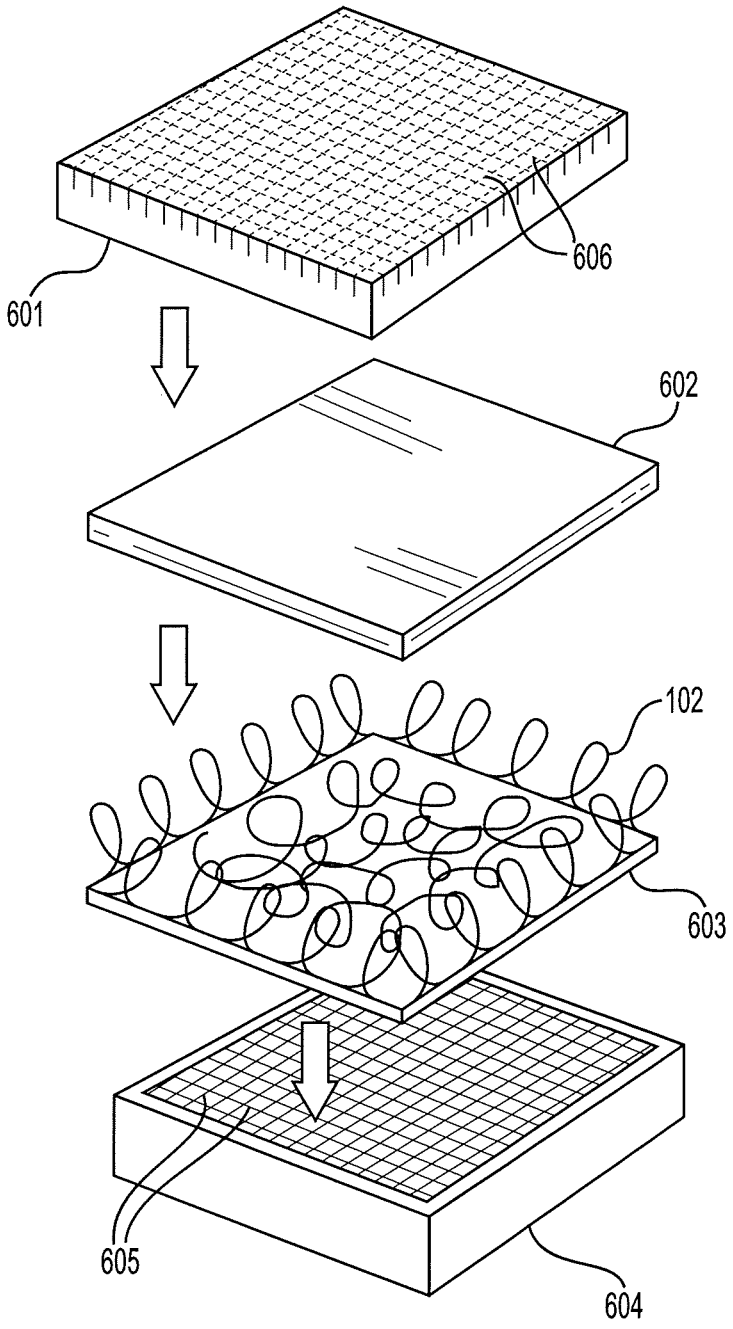
FIG. 6 shows an embodiment of another method of forming packets of insulation material.

With reference to FIG. 6, this disclosure also relates to another method for forming a packet of insulation material, the method comprising: (i) laying an insulation material on a surface of a first sheet 603 comprising a thermoplastic, (ii) placing a second sheet 602 comprising the thermoplastic on top of the insulation material thereby forming a sandwich, (iii) placing the sandwich between a top plate 601 and a bottom plate 604 of a die set, wherein a surface of the top plate has a plurality of ridges 606 parallel and perpendicular to a longitudinal axis of the top plate, a surface of the bottom plate has a plurality of grooves 605 parallel and perpendicular to a longitudinal axis of the bottom plate, and each ridge is sized to fit into each groove, and (iv) segmenting the sandwich by applying a pressure to the top plate of the die set thereby forming the packet of insulation material.

Each of a width and a length of the first sheet may range from 0.5-5 m, such as 0.5-3 m, and 0.5-1.5 m, a thickness of the first sheet ranges from 0.1-10 mm, such as 0.5-7 mm, and 1-3 mm. These dimensions are also applicable to the second sheet. The first and second sheets may be rectangles or squares. Preferably, the first and second sheets are squares. The insulation material is spread over a surface of the first sheet manually or by a distributing system known to those skilled in the food and/or packaging industries. In one embodiment, there is no adhesive layer between the layer of insulation material and the surface of the first sheet. In another embodiment, an adhesive layer is present. Non-limiting examples of adhesives are epoxy adhesives, acrylic adhesives, polyurethane adhesives, and silicone adhesives.

A pneumatic press or a hydraulic press may be employed to exert a pressure on the die set. For example, a hydraulic press is used and the pressure may range from 50-200 psi, such as 80-160 psi, and 130-150 psi. Non-limiting examples of grooves are V-groove, J-groove, and U-groove. Preferably, V-grooves are indented on the surface of the bottom plate. The distance between a pair of parallel grooves, and hence a pair of parallel ridges, can range from 2-15 cm, such as 2-10 cm, and 2-7 cm. At least one of the top plate and the bottom plate may be heated, for example by an internal heating element, to seal the edges of the segments.

The packet of insulation material may be color-coded by employing tube material or sheet material of different colors, and/or by printing and/or by labeling to facilitate identification of the contents and/or the insulation value (e.g., R-value). For example, a packet of silica aerogel particles may have a blue casing, and a packet of silica aerogel particles and polystyrene beads in a 1:1 volume ratio may have a red casing. In another embodiment, the tube material or sheet material is transparent, and filler materials of different colors may be used.

The packets can then be packaged into bags 401, distributed and then easily installed into a cavity of a wall 301 by hand, gravity, or blown in under pressure similar to traditional blown in insulation. The light weight, modular nature of these packets makes them ideal for this type of installation. This approach is easy to work with and has no negative side effects to installers because the insulation packet is capable of being installed by an installer without physically contacting the body of insulation material contained therein. The packets of insulation material may be added to buildings in areas such as wall cavities, attic spaces (between and over the floor joists to seal off living spaces below), between the studs of walls, between the studs and rafters of walls and roof, floors and ceilings. Combinations of different packages, e.g., having different R-values, can be provided depending on the spaces and the desired result.

The invention claimed is:

1. A method for forming a packet of insulation material, the method comprising:

injecting an insulation solid material into an interior volume of a tube having a closed first end and an opened second end with an injection apparatus inserted into the second end of the tube; and segmenting the tube thereby forming the packet of insulation material, wherein the tube is segmented with a cutter assembly comprising at least one cutting unit which comprises:

a blade to divide the tube into a plurality of segments; and a heated plate to seal cut edges of each segment thereby forming the packet of insulation material, and wherein the blade bisects the heated plate and is perpendicular to the heated plate.

2. The method of claim 1, wherein the tube is made of a moisture permeable material.

3. The method of claim 1, wherein the tube is segmented with at least one heated blade.

4. The method of claim 1, wherein there are at least three cutting units and the cutting units are spaced apart equally.

5. The method of claim 1, wherein the tube is round and comprises a thermoplastic.

6. The method of claim 5, wherein the tube comprises spun polyethylene.

7. The method of claim 1, wherein the injection apparatus injects the insulation material into the interior volume of the tube with pressurized air.

8. The method of claim 7, wherein the pressurized air has a pressure ranging from 80-160 psi.

9. The method of claim 1, wherein the insulation material comprises at least one material selected from the group consisting of silica aerogel in the form of a powder, fiberglass, and mineral wool.

10. The method of claim 9, wherein the insulation material further comprises at least one polymer selected from the group consisting of polyester, cellulose, polystyrene, and polyurethane.

11. The method of claim 10, wherein silica aerogel is present, and a volume ratio between silica aerogel to the at least one polymer is from 30:70 to 99:1.

* * * * *